US011234467B1

(12) United States Patent
Olsgard et al.

(10) Patent No.: US 11,234,467 B1
(45) Date of Patent: Feb. 1, 2022

(54) TUCK NO TUCK APPAREL

(71) Applicants: Peter Olsgard, Cresco, IA (US); Philip Henry, Cresco, IA (US)

(72) Inventors: Peter Olsgard, Cresco, IA (US); Philip Henry, Cresco, IA (US)

( * ) Notice: Subject to any disclaimer, the term of this patent is extended or adjusted under 35 U.S.C. 154(b) by 84 days.

(21) Appl. No.: 16/244,585

(22) Filed: Jan. 10, 2019

Related U.S. Application Data

(63) Continuation-in-part of application No. 15/826,025, filed on Nov. 29, 2017, now abandoned, which is a continuation-in-part of application No. 15/252,796, filed on Aug. 31, 2016, now abandoned.

(51) Int. Cl.
*A41B 1/10* (2006.01)
*A41B 9/06* (2006.01)

(52) U.S. Cl.
CPC ..... *A41B 1/10* (2013.01); *A41B 9/06* (2013.01); *A41B 2300/22* (2013.01); *A41B 2300/332* (2013.01); *A41B 2300/35* (2013.01)

(58) Field of Classification Search
CPC ..... A41B 1/10; A41B 9/06; A41B 2300/22; A41B 2300/332; A41B 2300/35; A41B 1/08; A41B 1/20; A41B 1/14; A41D 2300/22
See application file for complete search history.

(56) References Cited

U.S. PATENT DOCUMENTS 363,486 A * 5/1887 Smith ..... A41F 5/00 2/229
411,250 A * 9/1889 Leavitt ..... A41F 5/00 2/229
512,254 A * 1/1894 Lyon ..... A41F 5/00 2/229
622,571 A * 4/1899 Wald ..... A41F 5/00 2/229
716,421 A * 12/1902 Hoyt ..... A41F 5/00 2/229
719,851 A * 2/1903 Oppenheim ..... A41F 5/00 2/229
887,610 A * 5/1908 Epstein ..... A41D 1/21 2/221
946,400 A * 1/1910 Koehl Ruebe ..... A41F 5/00 2/107
1,050,715 A * 1/1913 Bartell ..... A41F 5/00 2/117
1,112,387 A * 9/1914 Schneer ..... A41D 1/18 2/106
1,184,887 A * 5/1916 Sprague ..... A41D 1/18 2/106
1,210,486 A * 1/1917 Kaplan ..... A41F 5/00 2/107

(Continued)

FOREIGN PATENT DOCUMENTS

EP 1332686 A2 * 8/2003 ..... A41D 15/00

*Primary Examiner* — Alissa L Hoey
(74) *Attorney, Agent, or Firm* — Eggink & Eggink; Anthony G. Eggink; Katrina M. Eggink

(57) ABSTRACT

A versatile tuckless shirt having a flexible body with a hem at its bottom terminal edge. A length of an elastic band shorter than the circumferential length of the hem is fixed within the hem whereby a user may fold the bottom of the shirt upward and into the interior of the shirt body to provide the look of a tucked shirt.

17 Claims, 2 Drawing Sheets

(56) References Cited

U.S. PATENT DOCUMENTS 1,226,654 A * 5/1917 Gordon ..... A41D 1/18 2/106
1,239,989 A * 9/1917 Wait ..... A41F 5/00 2/107
1,786,105 A * 12/1930 Clark ..... A41B 1/00 2/115
1,986,508 A * 1/1935 Leighton ..... A41F 5/00 2/107
1,999,915 A * 4/1935 Pines ..... A41F 5/00 2/117
2,027,641 A * 1/1936 Heymann ..... A41B 1/00 2/106
2,059,826 A * 11/1936 Tartikoff ..... A41F 5/00 2/107
2,418,774 A * 4/1947 Katz ..... A41B 1/00 2/115
2,615,166 A * 10/1952 Rowan ..... A41B 1/00 2/128
2,994,091 A * 8/1961 Aftergood, Jr. ..... A41F 9/025 2/243.1
4,601,069 A * 7/1986 Fiore, Jr ..... A41D 1/18 2/106
4,616,366 A * 10/1986 Mueller ..... A41B 1/10 2/115
5,758,366 A * 6/1998 Wilson ..... A41F 9/02 2/311
6,076,187 A * 6/2000 Wallerstein ..... A41B 1/00 2/115
7,340,780 B2 * 3/2008 Levy ..... A41D 1/04 2/107
7,650,650 B2 * 1/2010 Voege ..... A41D 1/04 2/269
10,779,584 B1 * 9/2020 Smith ..... A41D 13/1254
2004/0083529 A1 * 5/2004 Tate ..... A41D 27/20 2/115
2004/0181844 A1 * 9/2004 Kim ..... A41D 3/02 2/93
2006/0010559 A1 * 1/2006 Hamlet ..... A41F 5/00 2/117
2006/0048267 A1 * 3/2006 Keeter ..... A41D 27/18 2/141.2
2006/0105672 A1 * 5/2006 Donnelly ..... A41C 3/0057 450/3
2006/0150298 A1 * 7/2006 Jones ..... A41D 3/00 2/93
2008/0134409 A1 * 6/2008 Karasina ..... A41D 1/04 2/117
2012/0137408 A1 * 6/2012 Brown ..... A41D 23/00 2/207
2014/0143929 A1 * 5/2014 Curran ..... A41D 27/14 2/69
2015/0305411 A1 * 10/2015 Caco ..... A41D 7/008 2/69
2016/0183600 A1 * 6/2016 Patterson ..... A41B 1/10 2/128
2016/0219955 A1 * 8/2016 Uy ..... A41D 13/0015
2016/0338414 A1 * 11/2016 Siegfried ..... A41D 1/06
2016/0366948 A1 * 12/2016 Diaz ..... A41D 27/06
2017/0280780 A1 * 10/2017 Janes ..... A41F 17/00
2018/0055116 A1 * 3/2018 Henry ..... A41D 27/24
2018/0228220 A1 * 8/2018 Meyer ..... A41B 9/06
2019/0297973 A1 * 10/2019 Ponich ..... A41D 13/129
2019/0328060 A1 * 10/2019 Frazzini ..... A41D 15/00
2020/0378040 A1 * 12/2020 Aleman ..... A41D 27/08

* cited by examiner

TUCK NO TUCK APPAREL

This application is a Continuation-in-Part of U.S. patent application Ser. No. 15/826,025, filed on Nov. 29, 2017, which is a Continuation-in-Part of U.S. patent application Ser. No. 15/252,796, fled on Aug. 31, 2016.

BACKGROUND OF THE INVENTION

The present invention relates to a shirt having an elastic band or strip for managing the shirt's hemline near the waist; and more particularly, to a versatile shirt adapted to form fit the lower section of the shirt near the hemline to give a wearer the appearance of a tucked in shirt look.

Apparel worn on the upper part of a body generally referred to as shirts include a variety of clothing including formal and casual shirts, t-shirts etc. It is a general human tendency to modify existing clothing or invent a new type of clothing for a more comfortable and aesthetic look. Moreover, clothing can be classified as formal, causal and party wear; wherein, a particular piece of clothing may be more suitable to a particular occasion. For example, in the work place, more formal clothing may be generally preferred whereas in a social event, informal wear may be more suitable. In addition, it is well known that a type of clothing reflects the personality, taste and other characteristics of a wearer, and thus the clothing has been adapted to make it more appropriate for a particular situation, and as a fashion statement.

Prior art disclosing different types of clothing adapted to a particular situation includes U.S. Pat. No. 7,340,780 issued to Levy Edward M., disclosing a sports garment including a pullover shirt having inner and outer lower layers wherein inner lower layer is worn tucked into pants to provide comfort and support to the wearer and outer lower layer worn outside of the pants to provide the wearer with a neat and trim appearance. Another U.S. Pat. No. 8,087,094 issued to Svetlana Karasina teaches a shirt for supporting and shaping the mid-section of a wearer wherein mid-section of the shirt includes an upper and lower region with each constructed having a plurality of fabric densities or integrated elasticity portions. Yet another U.S. Pat. No. 7,650,650 issued to Voege James A. teaches a T-Shirt having rolled sleeves and a torso portion configured to cover a portion of a torso of the person.

It is clear that a need exists for modified clothing that is more convenient to wear and which provides an aesthetic appearance. The tuck no tuck shirt or tuckless shirt of the present invention overcomes the shortcomings and limitations of the prior art.

SUMMARY OF THE INVENTION

A versatile tuckless shirt having a flexible body with a hem at its bottom. A length of an elastic member or band shorter than the circumferential length of the hem is fixed within the hem to produce an elastic cincture whereby a user may fold the bottom of the shirt inward and adjustably upward and into the interior of the shirt body to the wearer's waist area to thereby provide the look of a tucked shirt or alternatively to extend the shirt down the torso of the body.

The versatile tuckless or tuck no tuck shirts of the present invention may have a ¼, 3/16 or ⅜ inch elastic band or ⅛ inch diameter elastic cord in the hem at the bottom of a tee shirt, golf shirt, golf polo, oxford, dress shirt or like clothing garment. The elastic band or cord is positioned and preferably fixed within the hem at the bottom of the shirt. In one embodiment, the cord or elastic band is inserted through the hem of the shirt and then sewn together. An eyelet may be made in the hem to insert the cord or elastic band through the hem and is then sewn shut, on the left side of the shirt, for example. For durability the elastic band or cord may be sewn to the eyelet to keep the elastic band or cord in place. In another embodiment, the elastic member may be secured in the terminal ends of the hem or placket portions of a button down shirt. The length of the elastic band or cord is approximately 50-75% of the circumferential length of the hem of the shirt in adult sizes and for youth shirts the elastic band length may be approximately 50-75% of the circumferential hem length, the latter utilizing a smaller width elastic band.

The versatile tuckless shirt provides a plurality of benefits to the wearer, both from a functional and visual standpoint. The versatile tuckless shirt or tuck no tuck t-shirt does as its name suggests in that it removes the need to tuck in a t-shirt or the like while keeping the professional, clean-cut look that a properly tucked-in shirt provides. The versatile shirt is designed and constructed to be adjustable for wearers who would rather not tuck in their shirt, but still want that on point, decisive look. The elastic cincture may also provide a protective barrier around the waist of the wearer, thereby preventing insects from crawling up the torso or preventing cold wind from blowing up the chest area, for example. The latter use being desirable for bicycle and motorcycle riders, for example. Further, if a wearer does wish to tuck in the shirt of the present invention, the elastic bottom hugs the body and provides a shirt which does not bunch or become untucked.

The shirt of the invention may be made of cotton, polyester and like fabrics. When worn, them is little indication that the no tuck t-shirt is any different from any other shirt one might wear. At the bottom of the no tuck t-shirt is a ¼-⅜ inch or similar elastic band or cord inserted into the hem to create an elastic cincture. The elastic band offers a clean, natural look to the bottom of the shirt that, when worn, appears to be tucked into the user's pants, shorts or skirt, for example.

The versatile tuckless or tuck no tuck shirt is constructed for those working any sort of job that requires a tucked in shirt. By retaining the clean look of a tucked-in shirt without actually being tucked, the tuck no tuck shirt of the invention retains the best of both worlds. The wearer looks put-together, professional and clean without having the often uncomfortable feel and wrinkled look of a shirt tucked in all day long. Furthermore, because there is no shirt fabric literally under one's pants, shorts or skirt, there is no fear of the undesirable bunching of portions of the shirt together, nor is there a chance that the shirt will balloon or wrinkle from being tucked in. Wearers can move freely, especially restaurant servers, construction workers or anyone engaged in an active lifestyle, without fear that their tucked in shirt will suffer any fashion malfunctions such as coming untucked, wrinkling or becoming bunched together in an undesirable manner.

Actions or movements such as a car ride or a walk up a flight of stairs can make a perfectly tucked shirt come undone. It is inconvenient to consistently adjust a tucked in shirt. When sitting down, leaning over, bending down to tie shoes or pick up a dropped pen, for example, a shirt may need to be readjusted.

The present invention provides the advantage that once the garment is on, it looks tucked and clean, carefully ironed and remains in that state. Another advantage is to provide a shirt that is adjustable, comfortable, stays in place and constantly looks tucked in for active wearers, i.e., restaurant and construction workers. A further advantage is to provide a garment that prevents insects or cold wind from a wearer's skin. Yet another advantage is to provide garment with a clean, neat look for children who are active and perhaps not able to tuck in a shirt for themselves. Yet a further advantage of the present invention is to provide a versatile shirt which, if tucked in to pants, for example, does not bunch and become uncomfortable and does not come untucked, thereby reducing the need to provide extra length at the bottom of a shirt.

These and other advantages of this invention will become clear from the following description by reference to the drawings.

DESCRIPTION OF THE PREFERRED EMBODIMENTS

Figure 1:
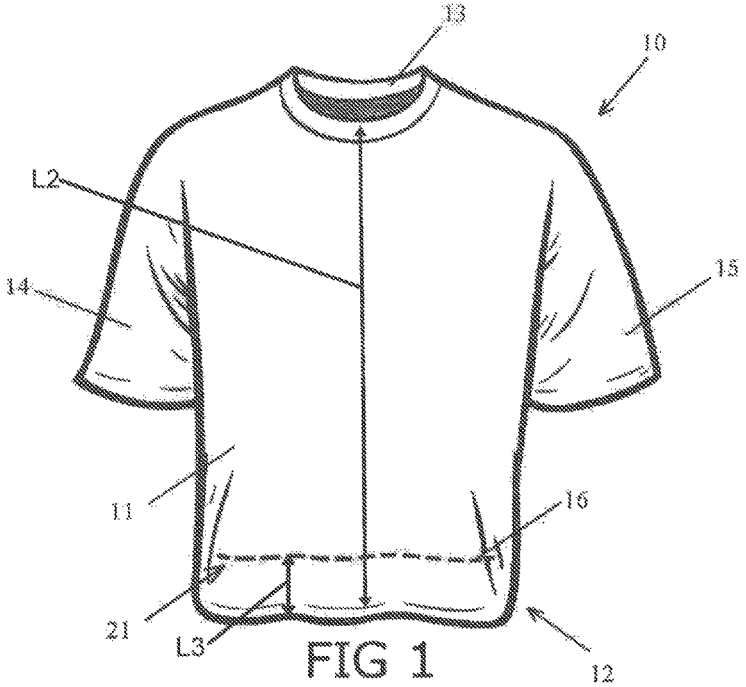
FIG. 1 is a frontal plan view of the versatile tuckless shirt of the invention and shown in a configuration as worn by the shirt wearer.
Figure 2:
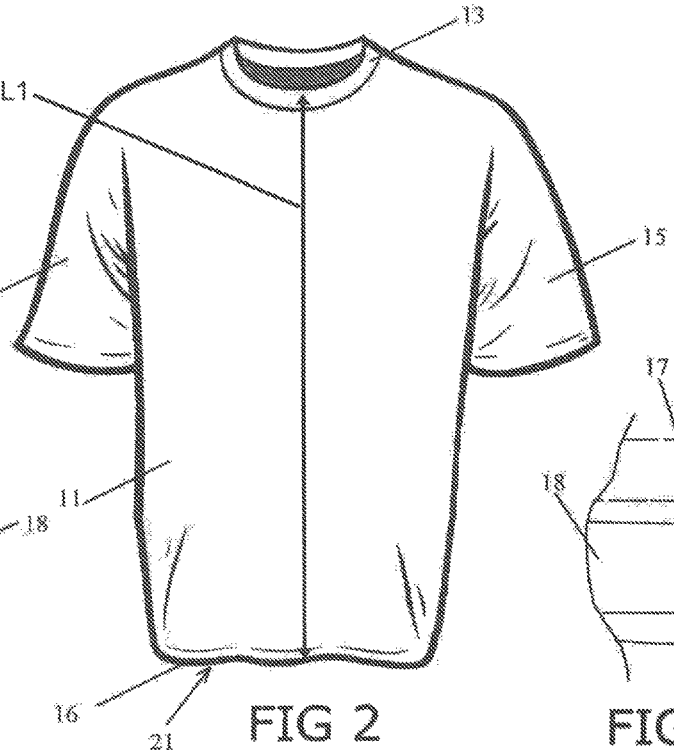
FIG. 2 is another frontal plan view of the invention.

Referring to FIGS. 1 and 2, the versatile tuckless T-shirt 10 is shown having a flexible body 11 with a neck opening 13 and opposing sleeves 14 and 15. The flexible body 11 is shown having a tubular configuration with a bottom portion 12 which in FIG. 1 is shown to be folded inward and upward as worn by a user whereby the hem 16 surrounds the user's waist and forms an elastic cincture 21, the latter comprising an elastic member or band within a continuous circumferential hem, as further discussed below. In FIG. 2, the hem 16 is shown in the downward tucked in position whereby the flexible body 11 of the versatile tuckless t-shirt 10 extends down the waist and legs of the wearer, and to thereby also provide perspective. In FIG. 2, the flexible tubular body length is shown to be L1 and in FIG. 1, the flexible body 11 is shown to have an exposed length L2 and a tucked up length L3 whereby L1=L2+L3. The versatility of the shirt of the invention provides a shirt having an elastic cincture and a length L1, wherein L1 is of a sufficient length, i.e., the standard length of a shirt sold or found in the marketplace to allow the shirt body to be tucked in or to be adjustably folded inward and upward to provide a tucked in look and to, thereby, control the exposed length L2 of the shirt.

The elastic band 18 may be perimetrically or circumferentially attached to an area in proximity to the lower shirt edge, i.e. near in proximity to the hemline 16. In other words, the elastic strip may be attached in direct proximity to the hemline 16 or a short distance above the hemline 16. In a manner of use, the person may tuck a portion of the lower section 14 of the shirt 10 inward and under the shirt 10 so that the elastic band 18 curtails loose fitting sections of the shirt 10 or lower sections of the shirt 10. This will create and maintain a tucked in appearance as shown in FIG. 1. Alternatively, as shown in FIG. 2, the person, particularly if heavy set, can tuck the hemline 16 of the shirt 10 into the person's trousers and the function of the elastic member or strip 18 is to keep and maintain a tucked in look. The shirt referenced can be anything from at-shirt, a casual dress shirt, or a formal dress shirt.

Figure 3:
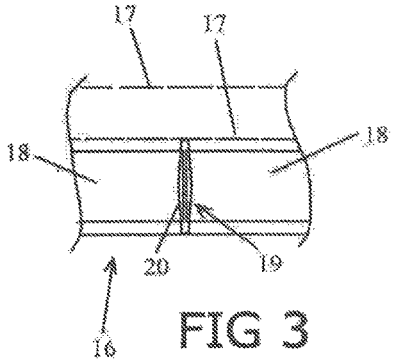
FIG. 3 is an enlarged cutaway view of the hem of the tuckless shirt.

Referring further to FIGS. 1 and 2 the benefit of the tuckless shirt 10 of the invention is shown. FIG. 2 shows the flexible shirt body 11 having a length L1. FIG. 1 shows hem 16 folded upward and inside the shirt body 11 whereby the exposed length L2 shortens the shirt body 11 with respect to the shirt length L1 of FIG. 2. The elastic member 18 within hem 16 as shown in FIG. 3 permits the wearer to adjust the exposed shirt body length L2 to a comfortable and desired length and to provide the tucked in shirt look of the invention. For example, a wearer having a relatively large midsection may also benefit from the shirt 10 structure by permitting the wearer to adjustably position the hem within trousers, or the like, and at a comfortable torso position. Thus, the exposed shirt body length L2 is obtained by folding the hem 16 at the bottom terminal edge of the shirt 10 a distance L3 upward against the torso of the wearer wherebyL1=L2+L3. This same adjustable exposed shirt body length may be realized in any shirt style, i.e., the dress shirt 25 shown in FIGS. 5 and 6 further discussed below.

The elastic band 18 may be formed or produced from stretchable materials such as spandex, nylon spandex, polyester spandex, rayon lycra, lycra spandex, cotton lycra, sateen fabric, nylon, elastane, latex, polybutylene terephthalate, neoprene, or any other material that stretches in a reformable manner when subjected to tensile stress. The size including length and width of the elastic strip 18 may be varied depending upon the type of material used in making the elastic strip, type of shirt, as well as the physique of the person likely to wear the shirt.

Figure 4:
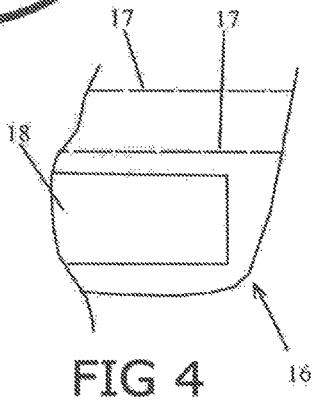
FIG. 4 is another enlarged view of the hem of the shirt and showing the elastic band therein.

Referring to FIGS. 3 and 4, the hem 16 is shown in an enlarged view. The hem 16 is folded inward at the bottom edge of the flexible body 11 and is formed via stitching 17. The hem 16 is shown to have an eyelet 19 which is preferably positioned on the side of the shirt's flexible body 11. An elastic band 18 is shown positioned within hem 16 and secured at the eyelet 19 by means of stitching 20. An exemplary hem 16 may be approximately ½ inch in height for receiving a ¼ inch elastic band 18, for example. The elastic band 18 within hem 16 forms an elastic cincture 21.

As shown in FIGS. 3 and 4, the no tuck t-shirt 10 preferably has a 3/16, ¼, or ⅜ inch elastic band or ⅛ inch cord 18 enclosed in the hem 16 at the bottom of any tee shirt, golf shirt, golf polo, oxford, dress shirt or generally the hem 16 of any shirt 10. The cord or elastic band 18 is inserted through the hem 16 of the shirt 10 and then sewn together. The eyelet 19 where the cord or elastic band 18 is inserted in the hem 16 is subsequently sewn shut. The eyelet may be positioned on the left side of the shirt, for example. For durability the elastic band or cord 18 may preferably be sewn to the eyelet 19 to keep the elastic band or cord 18 in place. The length of the elastic band or cord 18 is preferably 25-50% less than the circumferential length or 50-75% of the circumferential length of the hem 16 or elastic cincture of the shirt for adult sizes and for youth shirts the elastic is preferably about 75% the length of the circumferential length of the hem of the shirt. In other words, the elastic cincture formed by the elastic band 18 is approximately 50-75% of the bottom periphery length.

Figure 5:
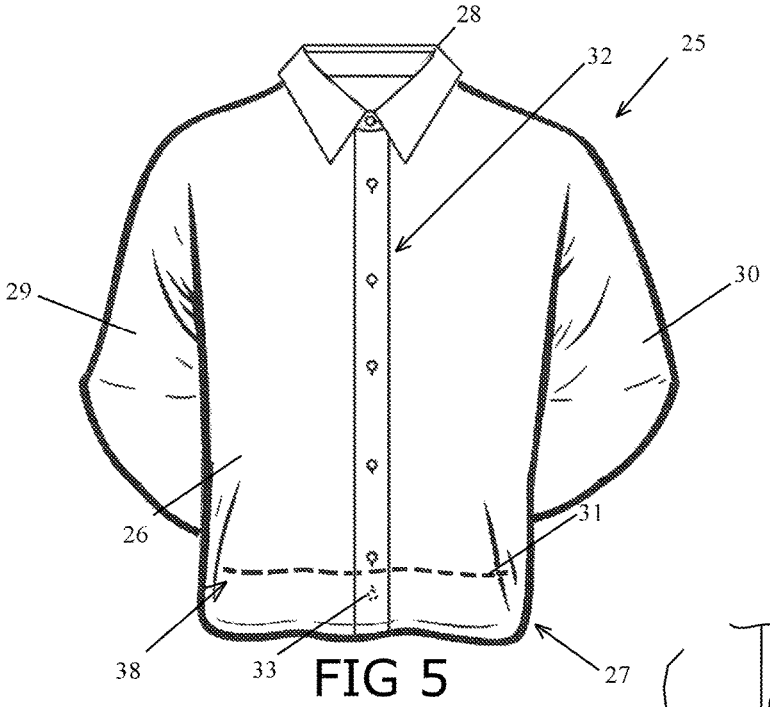
FIG. 5 is a frontal plan view of another embodiment of the shirt of the invention and shown in a configuration as worn by the shirt wearer.
Figure 6:
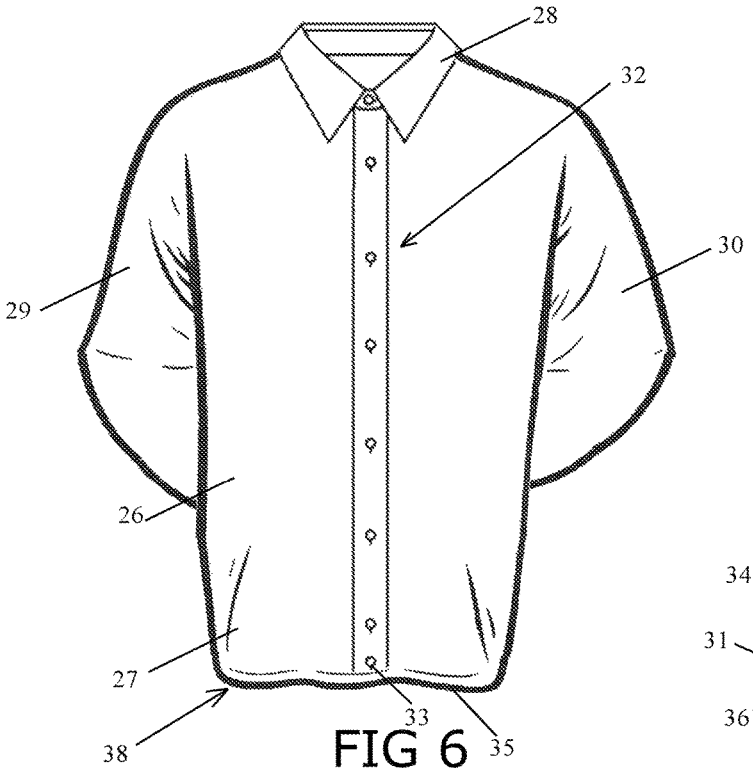
FIG. 6 is another frontal plan view of the invention of FIG. 5.

Referring the FIGS. 5 and 6, a dress shirt 25 is shown having a flexible body 26, a bottom portion 27, a collar 28 and sleeves 29 and 30. An elastic band or cord 31 is shown positioned in the bottom portion 27 to form an elastic cincture 38. The tuckless dress shirt 25 has a button down front 32 having a bottom button 33.

Figure 7:
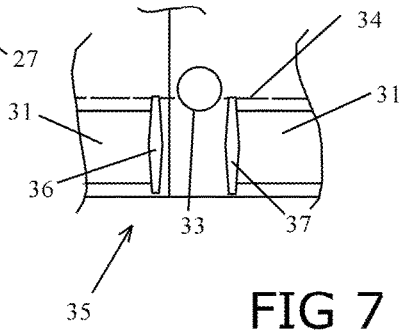
FIG. 7 is an enlarged cut away view of the hem of the shirt of FIG. 5.

As particularly shown in FIG. 7, the bottom portion 27 has a hem 35 formed by stitching 34 or the like. The elastic band or cord 31 is shown secured at its terminal ends by means of stitching 36 and 37. Importantly, bottom button 33 is shown positioned generally in alignment with hem 35, thereby providing the tuckless dress shirt 35 with its function of enabling the wearer to adjustably fold the bottom portion 27 upward and inward to provide the tucked look of the invention. Additionally, for heavy set wearers or the like, this structure enables the shirt bottom to be secured below the belly of the wearer when unfolded and to provide a tucked in look.

Figure 8A:
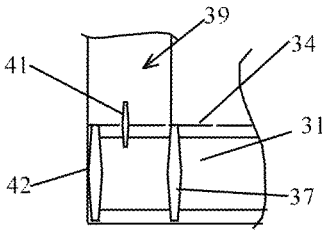
FIG. 8*a* is an enlarged cut away view of the hem and button hole placket of the tuckless shirt of the invention.
Figure 8B:
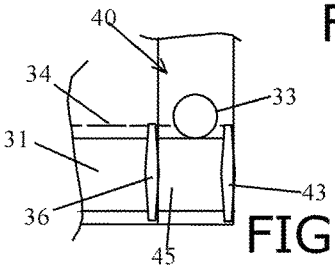
FIG. 8*b* is an enlarged cut away view of the hem and button placket of the tuckless shirt of the invention.

Referring to FIGS. 8*a* and 8*b*, the tuckless dress shirt 25 may have button hole placket 39 and button placket 40 extending vertically on the front portion 32 of shirt 25. Bottom button hole 41 and bottom button 33 are shown, respectively, on plackets 39 and 40 and with respect to hem 35. The terminal ends of the elastic member 31 are shown secured by stitching 42 and 43 within hem 35. Terminal portions 44 and 45 of the elastic member 31 are in a relaxed or unstretched state and defined by stitching 37, 42 and 36, 43, respectively.

In summary, as shown in FIGS. 1-7, an elongated elastic band or cord is inserted in a formed hem to form an elastic cincture at the terminal bottom end or bottom edge of the flexible body of a shirt. The hem has a predetermined peripheral length, and the elastic band or cord is approximately 50-75% of the length with respect to the circumferential hem length. The elastic band may range in width from 3/16 to 3/8 inches or have a diameter of approximately 1/8 inch. In one embodiment, the elastic band or cord may be secured at the eyelet of the hem where the elastic band or cord has been inserted into the hem. In another embodiment, the elastic band or cord is secured in the ends of the hem in general alignment with a button or the like.

As shown in the drawings, t-shirt 10 and button down, dress shirt 25 have normal or standard body lengths, thereby allowing the respective garments to be provided with the respective elastic cinctures 21 and 38 by means of elastic bands 18 and 31 within hems 17 and 34, respectively. In FIGS. 1 and 5, the elastic cinctures 21 and 38 of the respective shirts are shown in a wearing position, whereas in FIGS. 2 and 6, the elastic cinctures of the shirts are shown in the shirts' elongated positions to show perspective and as worn when tucked in. The hems at the terminal bottom edges of the respective garments are approximately 1/2 inch in height to receive the 3/16-3/8 inch wide elastic bands, for example. The body length of the garments 10 and 25 are sufficient to permit the elastic cinctures to be brought inwards and upwards on the wearer's body and towards the wearer's waist to provide an adjustable tucked in shirt look.

Although the use of the elastic band or cord is shown in the drawings with respect to a continuous circumferential hem, it is within the purview of the invention to provide a shirt structure with an openable front which utilizes a zipper or other fastening means other than buttons.

As many changes are possible to the tuckless shirt embodiments of this invention utilizing the teachings thereof, the descriptions above, and the accompanying drawing should be interpreted in the illustrative and not in the limited sense.

That which is claimed is:

1. A shirt having a flexible tubular shirt body with an outside surface, an inside surface, a length and a continuous bottom terminal edge comprising:

a) a continuous circumferential hem at said continuous bottom terminal edge of said flexible tubular shirt body, said continuous circumferential hem being disposed on said inside surface of said flexible tubular shirt body, said continuous circumferential hem having a first circumferential length and having an eyelet therein, b) an elongated elastic member having a second length, said second length being between 50-75% of said first circumferential length of said continuous circumferential hem, said elongated elastic member being an elastic band or cord and further having a width ranging from 3/16 to 3/8 inches or having a diameter of 1/8 inch, and c) said elongated elastic member being fixed and positioned within said continuous hem to form an elastic cincture at said continuous circumferential bottom terminal edge of said flexible tubular shirt body, said elongated member having terminal ends secured at said eyelet of said circumferential hem, whereby said elastic cincture when moved upwards within said tubular shirt body permits the length of said shirt body to be controlled and maintained.

2. The shirt of claim 1, wherein said elastic band or cord is selected from the group of materials consisting of spandex, nylon spandex, polyester spandex, rayon lycra, lycra spandex, cotton lycra, sateen fabric, nylon, elastance, latex, polybutene terephthalate, and neoprene.

3. The shirt of claim 1, wherein said second length of said elongated elastic member is 75% of said circumferential length of said hem.

4. The shirt of claim 1, wherein said circumferential hem has a height of 1/2 inch and wherein said shirt has a side portion and wherein said eyelet is located at said hem at said side portion of said shirt.

5. In a shirt having a flexible tubular shirt body constructed of a continuous fabric with a first length, an outside surface, an inside surface and a continuous circumferential bottom edge, the improvement comprising:

a) said continuous circumferential bottom edge of said flexible tubular shirt body having a continuous circumferential hem with a first predetermined circumferential length, said circumferential hem further having an eyelet therein;

b) an elastic band or cord ranging in length 50-75% of said first predetermined circumferential length of said circumferential hem; and c) said elastic band or cord being fixed and positioned within said circumferential hem to form a circumferential elastic cincture at said bottom edge of said flexible tubular shirt body, said elastic band or cord further being secured at said eyelet of said circumferential hem, whereby said circumferential hem when moved upwards said tubular flexible shirt body permits said first length of said outside surface of said flexible tubular shirt body to be adjusted in length and maintained in position when worn.

6. The improvement of claim 5, wherein said elastic band or cord has a width ranging from 3/16 to 3/8 inches or having a diameter of 1/8 inch.

7. The improvement of claim 5, wherein said length of said elastic band or cord is 75% of said circumferential length of said hem.

8. The improvement of claim 5, wherein said circumferential hem has a height of ½ inch.

9. The improvement of claim 5, wherein said shirt has a side portion and wherein said eyelet of said circumferential hem is located at said side portion of said shirt.

10. The shirt of claim 9, wherein said elongated elastic member has terminal ends secured at said eyelet of said hem.

11. The shirt of claim 5, wherein said elastic band or cord is selected from the group of materials consisting of spandex, nylon spandex, polyester spandex, rayon lycra, lycra spandex, cotton lycra, sateen fabric, nylon, elastance, latex, polybutene terephthalate, and neoprene.

12. A versatile shirt having a flexible tubular shirt body with a length, an outside surface, an inside surface, and a continuous bottom terminal edge comprising:

a) a continuous hem disposed at said continuous bottom terminal edge of said flexible tubular shirt body, said continuous hem having a first circumferential length;

b) an elongated elastic member having a second circumferential length, said second circumferential length of said elongated elastic member being between 50-75% of said first circumferential length of said continuous hem;

c) said elongated elastic member having a width ranging from 3/16 to 3/8 inches or having a diameter of 1/8 inch; and d) said elongated elastic member being fixed and positioned within said continuous hem to form an elastic cincture at said continuous bottom terminal edge of said flexible tubular shirt body, said continuous hem having an eyelet and wherein said elongated elastic member is an elastic band or cord and is secured at said eyelet of said continuous hem, whereby said elastic cincture provides a movable and stable bottom terminal edge for said versatile shirt hem when moved inside and upwards said flexible tubular shirt body to thereby permit the adjustment of the length of said outside surface of said flexible shirt body.

13. The versatile shirt of claim 12, wherein said elastic band or cord is selected from the group of materials consisting of spandex, nylon spandex, polyester spandex, rayon lycra, lycra spandex, cotton lycra, sateen fabric, nylon, elastance, latex, polybutene terephthalate, and neoprene.

14. The versatile shirt of claim 12, wherein said second circumferential length of said elongated elastic member is 75% of said first circumferential length of said hem.

15. The versatile shirt of claim 12, wherein said continuous hem has a height of ½ inch.

16. The versatile shirt of claim 12, wherein said shirt has a side portion and wherein said eyelet of said circumferential hem is located at said side portion of said shirt.

17. The versatile shirt of claim 12, wherein said elongated elastic member has terminal ends and wherein said terminal ends are fastened at said eyelet.

* * * * *